US009180515B2

(12) United States Patent
Okamoto et al.

(10) Patent No.: US 9,180,515 B2
(45) Date of Patent: Nov. 10, 2015

(54) MAGNESIUM ALLOY AND MAGNESIUM-ALLOY CAST PRODUCT

(75) Inventors: Yuki Okamoto, Kariya (JP); Kyoichi Kinoshita, Kariya (JP); Motoharu Tanizawa, Kariya (JP); Hiroya Akatsuka, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 607 days.

(21) Appl. No.: 13/129,046

(22) PCT Filed: Nov. 6, 2009

(86) PCT No.: PCT/JP2009/069308

§ 371 (c)(1),
(2), (4) Date: May 12, 2011

(87) PCT Pub. No.: WO2010/055897

PCT Pub. Date: May 20, 2010

(65) Prior Publication Data

US 2011/0220251 A1 Sep. 15, 2011

(30) Foreign Application Priority Data

Nov. 14, 2008 (JP) ..... 2008-292126

(51) Int. Cl.

| | |
|---|---|
| ***B22D 21/00*** | (2006.01) |
| ***C22C 23/02*** | (2006.01) |
| ***C22C 23/00*** | (2006.01) |
| ***C22F 1/06*** | (2006.01) |

(52) U.S. Cl.

CPC ..... *B22D 21/007* (2013.01); *C22C 23/00* (2013.01); *C22C 23/02* (2013.01); *C22F 1/06* (2013.01)

(58) Field of Classification Search

CPC ..... B22D 21/007; C22C 23/00; C22C 23/02; C22F 1/06

USPC ..... 420/407, 410, 413; 148/420

See application file for complete search history.

(56) References Cited

U.S. PATENT DOCUMENTS

| | | | | |
|---|---|---|---|---|
| 5,147,603 | A * | 9/1992 | Nussbaum et al. | 420/409 |
| 6,719,857 | B2 * | 4/2004 | Ohori et al. | 148/424 |
| 2001/0023720 | A1 | 9/2001 | Ohori et al. | |
| 2002/0104593 | A1 | 8/2002 | Pekguleryuz et al. | |
| 2007/0178006 | A1 | 8/2007 | Saikawa et al. | |

FOREIGN PATENT DOCUMENTS

| | | | |
|---|---|---|---|
| JP | 06-279906 | A | 10/1994 |
| JP | 08-041576 | A | 2/1996 |
| JP | 2000-319744 | A | 11/2000 |
| JP | 2001-316752 | A | 11/2001 |
| JP | 2001-316753 | A | 11/2001 |
| JP | 2002-327231 | A | 11/2002 |
| JP | 2002-363679 | A | 12/2002 |
| JP | 2003-517098 | A | 5/2003 |
| JP | 2004-162090 | A | 6/2004 |
| JP | 2004-232060 | A | 8/2004 |
| JP | 2005-113260 | A | 4/2005 |
| JP | 2006-291327 | A | 10/2006 |
| JP | 2007-070688 | A | 3/2007 |
| JP | 2007-197796 | A | 8/2007 |
| WO | 01/44529 | A1 | 6/2001 |

OTHER PUBLICATIONS

Japanese Office Action for corresponding JP Patent Application No. 2008-292126 dated Feb. 21, 2013.

* cited by examiner

*Primary Examiner* — Roy King
*Assistant Examiner* — Caitlin Kiechle
(74) *Attorney, Agent, or Firm* — Sughrue Mion, PLLC

(57) ABSTRACT

A magnesium alloy according to the present invention comprises: Al in an amount of from 2 to 6%; Ca in an amount making a compositional ratio (i.e., Ca/Al) being from 0.5 to 1.5; Mn in an amount of from 0.1 to 0.7%; strontium (Sr) in an amount of from 1 to 6%; and the balance being magnesium (Mg), and inevitable impurities and/or a modifying element; when the entirety is taken as 100% by mass. By means of this setting, Mg alloys, which are also good in terms of high-temperature characteristics, such as creep resistance and heat conductivity, in addition to ordinary-temperature characteristics, are obtained.

8 Claims, 8 Drawing Sheets

MAGNESIUM ALLOY AND MAGNESIUM-ALLOY CAST PRODUCT

CROSS REFERENCE TO RELATED APPLICATIONS

This application is a National Stage of International Application No. PCT/JP2009/069308 filed Nov. 6, 2009, claiming priority based on Japanese Patent Application No. 2008-292126 filed Nov. 14, 2008, the contents of all of which are incorporated herein by reference in their entirety.

TECHNICAL FIELD

The present invention relates to a magnesium alloy that is good in terms of high-temperature characteristics, and to a magnesium-alloy cast product that comprises that magnesium alloy.

BACKGROUND ART

Due to the recent heightening need in weight saving, magnesium alloy (or Mg alloy), which is more lightweight than aluminum alloy is, has been gathering attention. Magnesium alloy is about to be used widely for material for automobile, and the like, in addition to material for air craft, because it is the lightest in practical metals. A member comprising an Mg alloy (or Mg-alloy member) is lightweight, and is good in terms of functionality. Moreover, since using an Mg-alloy member leads to making vehicle, and so forth, lightweight, it is possible to intend energy saving.

In reality, however, in a case where an Mg-alloy member is utilized in vehicle, and the like, it is often the case that it has been required to have high-temperature characteristics, such as the heat conductivity, heat-resistance strength and creeping properties, that are suitable for employment in high-temperature environments. Although it is often the case that AZ91D, and so forth, have been used in common Mg-alloy members, such Mg-alloy members are not suitable for employment in high-temperature atmospheres because the creep strengths have been very low. Hence, a variety of Mg alloys whose high-temperature characteristics are improved have been proposed in the following: Japanese Unexamined Patent Publication (KOKAI) Gazette No. 6-279,906; Japanese Unexamined Patent Publication (KOKAI) Gazette No. 2000-319,744; Japanese Unexamined Patent Publication (KOKAI) Gazette No. 2001-316,753; Japanese Unexamined Patent Publication (KOKAI) Gazette No. 2002-327,231; Japanese Unexamined Patent Publication (KOKAI) Gazette No. 2004-162,090; Japanese Unexamined Patent Publication (KOKAI) Gazette No. 2004-232,060; Japanese Unexamined Patent Publication (KOKAI) Gazette No. 2005-113,260; Japanese Unexamined Patent Publication (KOKAI) Gazette No. 2006-291,327; Japanese Unexamined Patent Publication (KOKAI) Gazette No. 2007-70,688, and so on.

DISCLOSURE OF THE INVENTION

The present invention aims at providing the following: a new magnesium alloy (or Mg alloy), which is good in terms of each of high-temperature characteristics in contrast to conventional Mg alloys that are proposed in the aforementioned cited literatures, and the like; and a magnesium-alloy cast product (or Mg-alloy cast product), which comprises that Mg alloy.

The present inventors studied earnestly to solve this assignment; as a result of their repeated trial and error, they found out anew that, in a quintet-system Mg alloy like Mg—Al—Ca—Mn—Sr, Mg alloys that demonstrate good high-temperature characteristics are obtainable by adjusting the amounts of the alloying elements in regions that differ from the conventional compositional ranges; and they arrived at completing the present invention being described later based on this finding.

Magnesium Alloy (1) A magnesium alloy according to the present invention is characterized in that it comprises:

aluminum (Al) in an amount of from 2 to 5.5% by mass (hereinafter being simply referred to as "%");

calcium (Ca) in an amount making a compositional ratio of Ca with respect to the Al (i.e., Ca/Al) that is from 0.5 to 1.5%;

manganese (Mn) in an amount of from 0.1 to 0.7%;

strontium (Sr) in an amount of from 1 to 6%; and the balance being magnesium (Mg), and inevitable impurities and/or a modifying element;

when the entirety is taken as 100%; and it is good in terms of high-temperature characteristic.

Moreover, a magnesium alloy according to the present invention is characterized in that it comprises:

aluminum (Al) in an amount of from 2 to 6% by mass (hereinafter being simply referred to as "%");

calcium (Ca) in an amount making a compositional ratio of Ca with respect to the Al (i.e., Ca/Al) that is from 0.5 to 1.5;

manganese (Mn) in an amount of from 0.1 to 0.7%;

strontium (Sr) in an amount of from 2 to 6%; and the balance being magnesium (Mg), and inevitable impurities and/or a modifying element;

when the entirety is taken as 100%; and it is good in terms of high-temperature characteristic.

(2) The Mg alloy according to the present invention is good not only in terms of ordinary-temperature characteristics, such as hardness, tensile strength and elongation in ordinary-temperature region, but also in terms of heat conductivity as well as high-temperature characteristics, such as creep resistance (the magnitude of stress drop, for instance) in high-temperature region.

Although reasons why the Mg alloy according to the present invention demonstrates such good characteristics have not been necessarily clear yet, it is believed as follows: Al—Sr-system compounds, whose melting points are high and which are hard, crystallize or precipitate in the Mg alloy concertedly with Al—Ca-system compounds because Sr exists in an adequate amount in addition to Al, Ca and Mn; and additionally compounds whose melting points are low are meanwhile inhibited from crystallizing or precipitating; and then the hardness, creep resistance, and the like, of the Mg alloy have upgraded as a whole unprecedentedly than ever before by means of a synergetic effect of those.

(3) Moreover, the Mg alloy according to the present invention is also good in terms of castability (e.g., the molten-metal flowability). The reason for this seems to be as follows: as a result that Sr has lowered the liquidus temperature of the Mg alloy, the resulting molten metal has become less likely to solidify during the pouring or filling. In addition, the Mg alloy according to the present invention is low in cost because it does not employ any expensive alloying elements, such as rare-earth elements (or R.E.), but employs Al, Ca, Mn and Sr, which are inexpensive relatively, as the indispensable alloying elements.

Magnesium-Alloy Cast Product (1) The Mg alloy according to the present invention is good not only in terms of high-temperature characteristics but also in terms of castability. Hence, the present invention can be grasped as a magnesium-alloy cast product as well, namely, as one of suitable examples of the aforementioned Mg alloy.

(2) And, in order to have the above-described good high-temperature characteristics demonstrated stably, it is suitable that a magnesium-alloy cast product according to the present invention can be one onto which the following have been performed:

a solution treatment in which it is cooled rapidly after being heated to a temperature that is higher than or equal to that of a solubility curve; and an aging heat treatment in which it is held at another temperature that is less than that of the solubility curve after the solution treatment.

Others (1) The "modifying element" being referred to in the present description is an element other than Al, Ca, Mn, Sr and Mg, and is a trace amount of an element that is effective in improving the characteristics of Mg alloy (or cast product). Although the types of characteristics to be improved do not matter at all, the following are available: hardness, strength, toughness, ductility, heat conductivity, heat resistance (e.g., creep resistance), and the like.

The "inevitable impurities" are impurities that are included in a raw-material powder, and are impurities, and the like, which are mixed accidentally, and so forth, during the respective steps; and are elements that are difficult to remove in view of costs, or due to technical reasons, and so on. In the case of being the Mg alloy according to the present invention, Fe, Ni, Cu, Si, Zn, and the like, are available therefor, for instance. Note that, as a matter of course, the compositions of modifying elements and inevitable impurities are not limited in particular.

(2) It is even allowable that, not limited to those made by ordinary gravity casting or pressure casting, this Mg-alloy cast product according to the present invention can be those made by die-cast casting, or it is also permissible that it can be those made using sand molds, or those made using metallic molds.

In the Mg-alloy according to the present invention, its form does not matter at all; and it is even allowable that the Mg-alloy cast product can be a workpiece that has a rod shape, a tube shape or a plate shape, and the like; or it is also permissible that it can have a final configuration or can even be a structural member per se that can approximate it. Of course, it is even advisable that the Mg-alloy cast product can be a cast workpiece (or ingot).

Although the term, "castability," is also indexed by means of the presence or absence of defects, such as cracks and cast cavities, in addition to molten-metal flowability, in general, the "castability" of Mg alloys have been evaluated mainly by means of molten-metal flowability in the present description. Moreover, in the term, "high-temperature characteristics" being referred to in the present description, high-temperature strength, creep resistance, and the like, that are indexed with the magnitude of stress drop, and so forth, are involved as a matter of course, heat conductivity, which indexes thermal conductivity (or thermal dissipation) when Mg-alloy cast products are employed in high-temperature environments, is also involved. The term, "ordinary-temperature characteristics," can be hardness, tensile strength, proof strength, elongation, toughness, and so forth, in ordinary-temperature region. In the present description, hardness, tensile strength, and elongation have been focused mainly as the ordinary-temperature characteristics.

(4) Unless otherwise specified especially, the designations, namely, "from 'x' to 'y'" being referred to in the present description, involve the lower limit, "x," and the upper limit, "y." Moreover, the upper limits and lower limits being set forth in the present description are combinable arbitrarily, and are thereby able to constitute such a range as "from 'a' to 'b'."

BEST MODE FOR CARRYING OUT THE INVENTION

Figure 1:
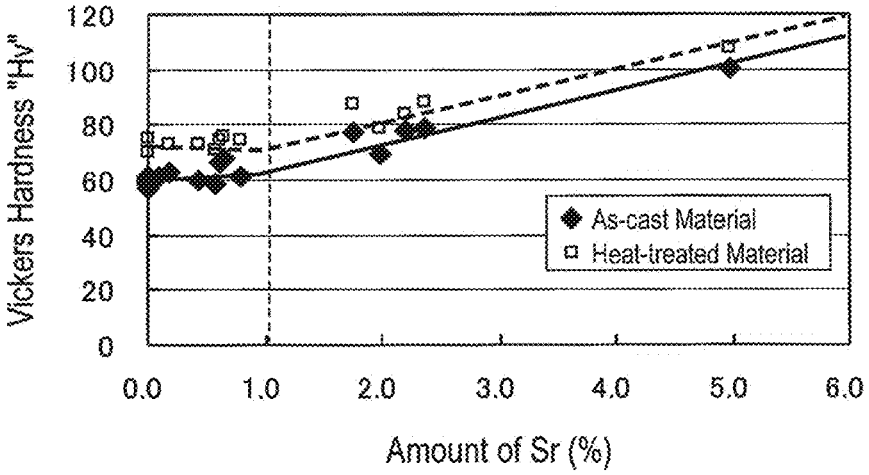
FIG. 1 is a graph that illustrates correlations between the hardnesses of Mg-alloy cast products and the Sr amounts.

The present invention will be explained in more detail while giving some of embodiment modes for the invention. Note that, although, involving embodiment modes below, contents being explained in the present description are properly applicable not only to the present Mg alloy but also to the present Mg-alloy cast product, they are simply referred to, involving the present Mg-alloy cast product, as the present "Mg alloy." Note that whether any one of the embodiment modes is considered best or not depends on subject matters, their required performance, and the like.

Componential Composition

(1) Al

Al dissolves into Mg crystalline grains to upgrade the room-temperature strength of the Mg alloy, and moreover to upgrade the corrosion resistance of the Mg alloy. In reality, however, when the Al amount in the Mg alloy increases, Al-rich phases are formable because Al dissolves into the matrix (e.g., dendritic cells, or a crystalline grains) supersaturatedly. Since these Al-rich phases are unstable thermally, they turn into Mg—Al-system compounds (e.g., $Mg_{17}Al_{12}$) in high-temperature region and then come to precipitate into Mg matrices, or into Mg-crystal grain boundaries. When this high-temperature state continues for a long time, those intermetallic compounds (i.e., the Mg—Al-system compounds) agglomerate to coarsen, thereby augmenting the creep deformations of the Mg alloy (namely, lowering the heat resistance).

Therefore, although no sufficient characteristics are obtainable when Al is too little, Al even being too much is not preferable because the high-temperature characteristics decline. Hence, it is preferable that Al can be from 2 to 6%. Although the upper and lower limits of this Al is selectable arbitrarily within the aforementioned numerical range, it is preferable especially that numerical values, which are selected arbitrarily from the group consisting of 2.5%, 3%, 3.5%, 4%, 4.5%, 5% and further 5.5%, can make the upper and lower limits.

(2) Ca

Ca inhibits the above-described decline of the heat resistance that is accompanied by the increase of Al. This is believed as follows: Ca reacts with the aforementioned Mg—Al compounds and matrices, thereby decreasing $Mg_{17}Al_{12}$ that becomes the factor of lowering creep; and additionally it forms Al—Ca-system compounds or Mg—Ca compounds, and the like, that are stable in high-temperature region.

It is believed that these Ca-system intermetallic compounds crystallize or precipitate mainly into crystal grain boundaries as network shapes, thereby effecting the wedge action that holds back the dislocation motions in the Mg alloy. Since such intermetallic compounds are obtainable by means of cooperation between Ca and Al, the Ca amount is not simply prescribed independently in the present invention, but is prescribed by means of its correlation with Al, that is, by means of the Ca/Al. When this Ca/Al is too little, the above-described advantages are not obtainable sufficiently; whereas, the Mg—Ca compounds crystallize excessively into crystal grain boundaries to deteriorate the elongation and toughness when the Ca/Al is too much. Hence, in the case of the present invention, it is preferable that the Ca/Al can be from 0.5 to 1.5. Although the upper and lower limits of this Ca/Al is selectable arbitrarily within the aforementioned numerical range, it is preferable especially that numerical values, which are selected arbitrarily from the group consisting of 0.7, 0.9, 1.1 and further 1.3, can make the upper and lower limits (3) Mn Mn dissolves into Mg crystalline grains in order for solid-solution strengthening the Mg alloy, along with reacting with Al as well to inhibit $Mg_{17}Al_{12}$, which makes a factor of lowering the creep, from precipitating. Therefore, Mn is an element that is capable of upgrading not only the ordinary-temperature characteristics of the Mg alloy but also the high-temperature characteristics thereof.

Furthermore, Mn also effects such an advantage as sedimentation removal of Fe, one of the impurities that make the cause of corroding the Mg alloy, without ever adversely affecting the castability of the Mg alloy.

When Mn is too little, such advantages are not obtainable; whereas, the hardness of the Mg alloy might possibly be declinable when Mn becomes too much. Hence, in the Mg alloy according to the present invention, it is preferable that Mn can be from 0.1 to 0.8%. Although the upper and lower limits of this Mn is selectable arbitrarily within the aforementioned numerical range, it is preferable especially that numerical values, which are selected arbitrarily from the group consisting of 0.2%, 0.3%, 0.4%, 0.5%, 0.6% and further 0.7%, can make the upper and lower limits.

(4) Sr

In the same manner as Ca, Sr is also an element that upgrades the high-temperature characteristics of the Mg alloy, because it decreases $Mg_{17}Al_{12}$ that becomes the factor of lowering creep and additionally because it forms Al—Sr-system compounds, and the like, that are stable in high-temperature region. Besides, since the resulting Al—Sr-system compounds are hard, they upgrade the wear resistance of the Mg alloy as well.

Besides, Sr effects the advantages, namely, upgrading the creep resistance (e.g., the decrease in the magnitude of stress drop) and hardness of the Mg alloy, more greatly than does the aforementioned Ca.

When this Sr is too little, the above-described advantages cannot be obtained sufficiently. On the other hand, even when Sr is too much, adverse effects are exerted less with respect to the mechanical characteristics of the Mg alloy. However, Sr being too much is not preferable because the heat conductivity of the Mg alloy declines. This is because the thermal conductivity and dissipation of the Mg alloy become poorer when the heat conductivity declines, and hence it is not possible to intend to expand the utilization as members that are employed in high-temperature environments.

Hence, in the Mg alloy according to the present invention, it is preferable that Sr can be from 1 to 6%. Although the upper and lower limits of this Sr is selectable arbitrarily within the aforementioned numerical range, it is preferable especially that numerical values, which are selected arbitrarily from the group consisting of 1.5%, 2%, 2.5%, 3%, 4% and further 5%, can make the upper and lower limits.

Heat Treatment

The Mg alloy according to the present invention demonstrates the above-described ordinary-temperature characteristics and high-temperature characteristics even in a state of being as cast (that is, being as-cast materials). In reality, however, when a heat treatment is further performed onto it, those characteristics come to be demonstrated in higher dimension and more stably.

As such a heat treatment, solution treatments and aging heat treatments are available, for instance. A solution treatment is a treatment in which an Mg alloy is cooled rapidly to ordinary temperature, and the like, after being heated to a temperature that is higher than or equal to the solubility curve. A supersaturated solid solution is obtainable by means of this, supersaturated solid solution in which the alloying elements are dissolved into Mg. An aging treatment is a treatment in which an Mg alloy, which has been cooled rapidly by a solution treatment, is held at a temperature that is less than the solubility curve (usually, a temperature that is a little bit higher than ordinary temperature). The Mg alloy's metallic structure changes gently by means of this, and thereby the Mg alloy's hardness, and so forth, upgrade.

The heating temperature and cooling rate, and the like, in a solution treatment, or the heating temperature and holding time, and so forth, in an aging heat treatment, are selected depending on the compositions, desired characteristics, and so on, of the Mg alloy. For example, it is preferable that the heating temperature in a solution treatment can be from 350 to 550° C., and the cooling rate therein can be from 0.3 to 500° C./sec. It is preferable that the heating temperature in an aging heat treatment can be from 150 to 300° C., and the holding time therein can be from 1 to 50 hours.

Applications

Beginning with the fields of space, military and aviation, applications of the Mg alloy according to the present invention can be extended to various fields, such as automobiles and home electric instruments. In reality, however, it is all the more suitable that, taking advantage of its heat resistance, the Mg alloy according to the present invention can be utilized in products being employed in high-temperature environments, such as engines, transmissions, compressors for air conditioner or their related products that are put in place within the engine room of automobile, for instance.

EXAMPLES

Test specimens were made in a plurality of pieces, test specimens whose contents (or addition amounts) of Al, Ca, Mn and Sr in magnesium alloys were varied variously; and then their high-temperature characteristics, ordinary-temperature characteristics and castabilities were evaluated. The present invention will be hereinafter explained in more detail based on these.

Manufacture of Test Specimens

(1) Casting of Test Specimens

Or Making of As-Cast Materials

A chloride-system flux was coated onto the inner face of a crucible being made of iron that had been preheated within an electric furnace, and then weighed raw materials were charged into it, and were then melted, thereby preparing molten metals (i.e., a molten-metal preparing step). As for the raw materials, the following were used: a pure Mg lump, a pure Al lump, a pure Ca lump, an Al—Sr alloy lump, an Mg—Mn alloy lump, an Al—Mn alloy lump, a pure Sr lump, and the like.

After fully stirring these molten metals to melt the blended raw materials completely, they were held calmly at the same temperature for a while. During this melting operation, a mixture gas of carbon dioxide gas and $SF_6$ gas was blown onto the molten metals' surface in order to prevent the burning of Mg, and a flux was further sprayed onto the molten metals' surface whenever being deemed appropriate.

After holding the thus obtained various alloy molten metals at 750° C., they were poured into a metallic mold (i.e., a molten-metal pouring step), and were then solidified in air atmosphere (i.e., a solidifying step). Thus, boat-shaped ingots (or as-cast materials, i.e., magnesium-alloy cast products) with 200 mm in length×40 mm in height×20 mm in lower-base width×30 mm in upper-base width were manufactured by means of gravity casting.

Analyzed compositions, the results of analyzing the chemical compositions of each of these test specimens, are given in Table 1A along with compositions (or blended compositions) that resulted from blending the raw materials upon casting those test specimens.

(2) Heat Treatment to Test Specimens

Or Making of Heat-Treated Materials

Heat-treated materials (or magnesium-alloy cast products), test specimens that were made by further performing a heat treatment onto the above-described test specimens as being cast (or as-cast materials), were also made ready. The heat treatment performed herein was the so-called T6 heat treatment. Concretely speaking, the T6 heat treatment comprised: a solution heat treatment in which test specimens, which had been held immediately beneath a eutectic temperature of from 350 to 550° C. (note that the specific temperature depended on the alloy composition of the test specimens), were cooled rapidly in air, in hot water or in oil, or even in air; and an aging heat treatment in which the test specimens being heat treated as above were subsequently held at 200° C. for from 1 to 50 hours within a heating furnace.

Measurements (1) High-temperature characteristics were measured for the test specimens that comprised the above-described as-cast materials and heat-treated materials. The "high-temperature characteristics" being referred to herein are the heat conductivity, and the creep property. The thermal conductivity was found by means of a laser flash method ("TC-7000" produced by ULVAC-RIKO) in air atmosphere at 25° C. Moreover, the creep resistance was indexed with such a magnitude that how much a stress being applied to the respective test specimens declined in air atmosphere at 200° C. after 40 hours (i.e., a magnitude of stress drop). Concretely speaking, an initial load of 100 MPa was applied to the above-described cylindrical test specimens with ϕ10×10 under an atmospheric temperature of 200° C., and an initial displacement at that time was maintained. And, a stress that was lowered by means of creep was measured after 40 hours had passed as it was, and then a decreased magnitude, a decremental difference of the resulting stress after 40 hours passed with respect to the 100-MPa initial load, was found as the stress-drop magnitude.

(2) Ordinary-temperature characteristics were measured for said as-cast materials and heat-treated materials. The "ordinary-temperature characteristics" being referred to herein are the hardness, the tensile strength, and the elongation. The hardness is a Vickers hardness to a load of 10 kgf in ordinary-temperature atmosphere (at about 25° C.).

The tensile (or fracture) strength and elongation were found by means of a tensile test (e.g., JIS Z-2241).

Figure 13:
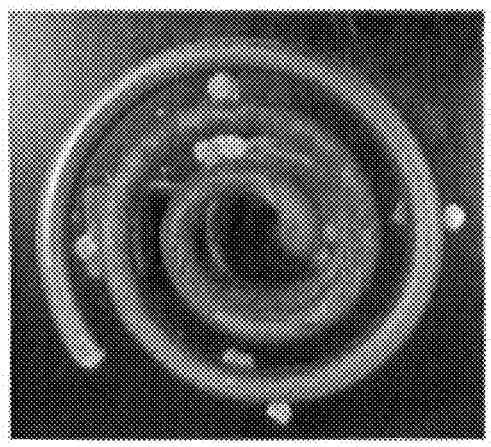
FIG. 13 is a photograph that illustrates the outline of a spiral mold.

The castability of the molten metal, which was prepared upon casting each of the test specimens, was indexed with a flow length being exhibited by an after-solidification cast product that was made by casting each of the molten metals into such a spiral sand mold as illustrated in FIG. 13. The spiral sand mold had a spiral shape whose inside diameter was ϕ30 mm and outside diameter was ϕ120 mm, and was adapted into being made of quarts sand. The pouring of the molten metals into the spiral sand mold was carried out in ordinary-temperature atmosphere (at about 25° C.). The spiral sand mold had been preheated to 100° C. before the pouring.

Results of the above-mentioned measurements are given in Table 1B all together. Note that, in Table 1B, results of comparative test specimens (i.e., comparative as-cast materials) that were cast using AZ91D that was available commercially as a common Mg alloy were also given in Table 1B combinedly, because the above-described respective characteristics were likewise measured and so forth for them.

Evaluation

Those like the following were understood from above-described Table 1A and Table 1B (hereinafter being simply referred to as "Table 1" combindely), graphs in which the analyzed values or measured values were plotted from out of them, and metallographic photographs on a variety of the test specimens.

(1) Influences of Sr

Correlations between the Sr amounts in the analyzed compositions of the respective test specimens and the characteristics of the respective test specimens are illustrated in FIG. 1 through FIG. 4 based on Table 1. Note that, on the graphs shown in these diagrams, data, in which the "Ca/Al" fell in a range of from 0.8 to 1.2, were plotted in order to make influences of Sr clear. Moreover, how metallic structures of the test specimens changed depending on the Sr amounts is shown in FIG. 5.

(i) First of all, as can be apparent from FIG. 1, it is seen that the hardness hardly changed in any one of the test specimens when Sr was less than 1% by mass (being simply referred to as "%" hereinafter). On the other hand, when Sr became 1% or more, the hardness started augmenting; the more the Sr amount augmented, the larger the hardness of the test specimens became.

This tendency was the same not only in the as-cast materials but also in the heat-treated materials. However, the heat-treated materials became larger in the hardness by from 10 to 15 Hv as a whole than did the as-cast materials. Therefore, regardless of the Sr amount, it is possible to stably enhance the hardness by performing a heat treatment onto the present Mg-alloy cast product.

Figure 2:
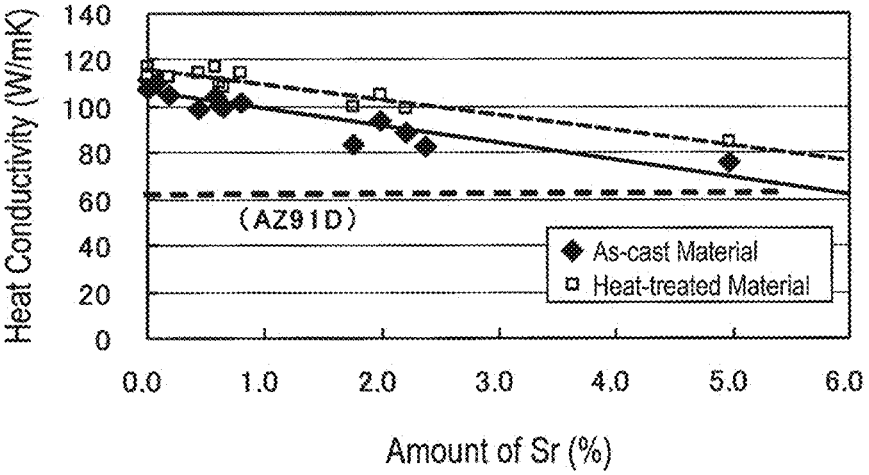
FIG. 2 is a graph that illustrates correlations between the heat conductivities of Mg-alloy cast products and the Sr amounts.

(ii) In reality, however, the increase in the Sr amount lowered the heat conductivity, as can be apparent from FIG. 2. It is understood that, in the test specimens whose Sr exceeded 6%, the heat conductivity became approximately equal to that of the conventional common Mg alloy (e.g., AZ91D).

This tendency was the same not only in the as-cast materials but also in the heat-treated materials. However, the heat-treated materials became larger in the heat conductivity by from 5 to 10 W/mk as a whole than did the as-cast materials. Therefore, it is possible to stably enhance even the heat conductivity, as well as the hardness, by performing a heat treatment onto the present Mg-alloy cast product.

Figure 3:
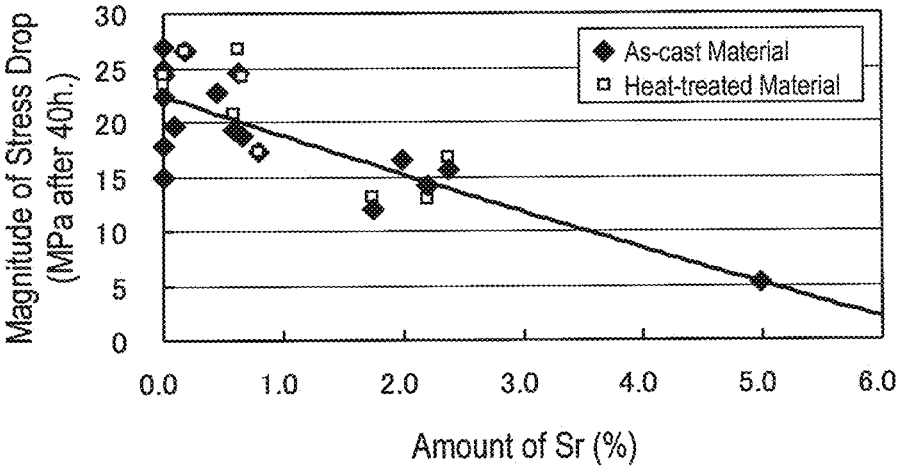
FIG. 3 is a graph that illustrates correlations between the stress-drop magnitudes of Mg-alloy cast products and the Sr amounts.

(iii) Moreover, as can be apparent from FIG. 3, the more Sr increased, the more the magnitude of stress drop decreased; and so the better creep characteristics came to be exhibited. This seems to occur because of the following: compounds of Sr and Al (or Al—Sr-system compounds) whose melting points are high increase, and hence the decline in strength at high temperature becomes smaller. And, this tendency was the same not only in the as-cast materials but also in the heat-treated materials, and so there was not any remarkable difference between both of them as to the magnitude of stress drop.

Figure 4:
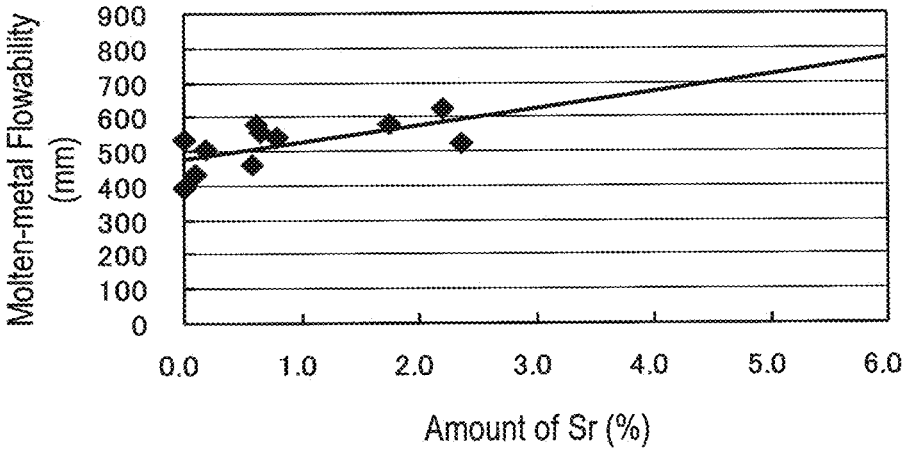
FIG. 4 is a graph that illustrates correlations between the castabilities (e.g., molten-metal flowabilities) of Mg-alloy cast products and the Sr amounts.
Figure 5:
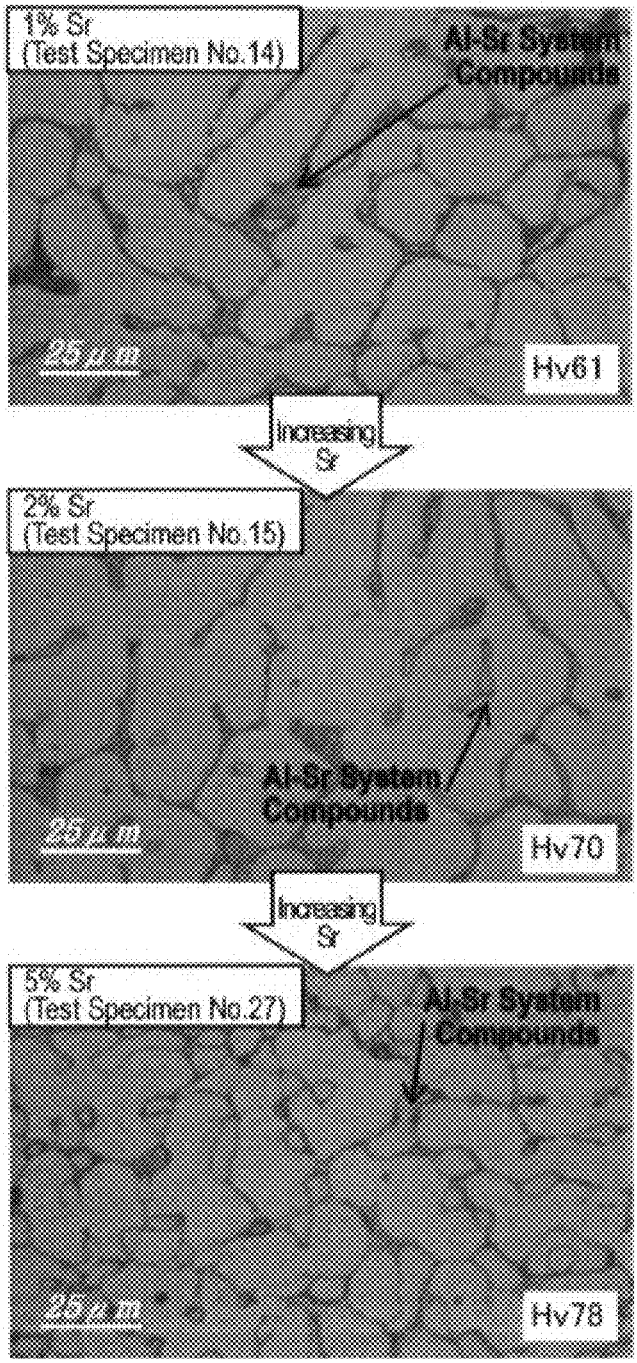
FIG. 5 is metallographic photographs that show the metallic structures of Mg-alloy cast products with different Sr amounts.

(iv) In addition, as can be apparent from FIG. 4, it was also understood that the more Sr increased the more the molten-metal flowability (i.e., castability) upgraded. This seems to occur because of the following: the molten metals become less likely to solidify because the liquidus temperatures are lowered by means of the increase in Sr.

From those above mentioned, it is possible to say that, in order to make the hardness of the test specimens compatible with the heat conductivity and the magnitude of stress drop in higher dimension, it is more preferable to set Sr so as to fall in a range of from 1 to 6%, or further in a range of from 1.5 to 2.5%.

(v) Note that, as can be seen from the metallic structures shown in FIG. 5, the hardness (and furthermore the magnitude of stress drop) of the test specimens was also augmented by means of the increase in Sr. This seems to occur because of the following: the hard Al—Sr-system compounds have been increased by means of the increase in Sr.

Moreover, the following also seem to contribute to the improvements in the high-temperature characteristics of the present Mg-alloy cast product: the more the Sr amount increases the greater the areal ratio of the Al—Sr-system compounds enlarges and so the more the grain configurations are spheroidized.

(2) Influences of Al

Figure 6:
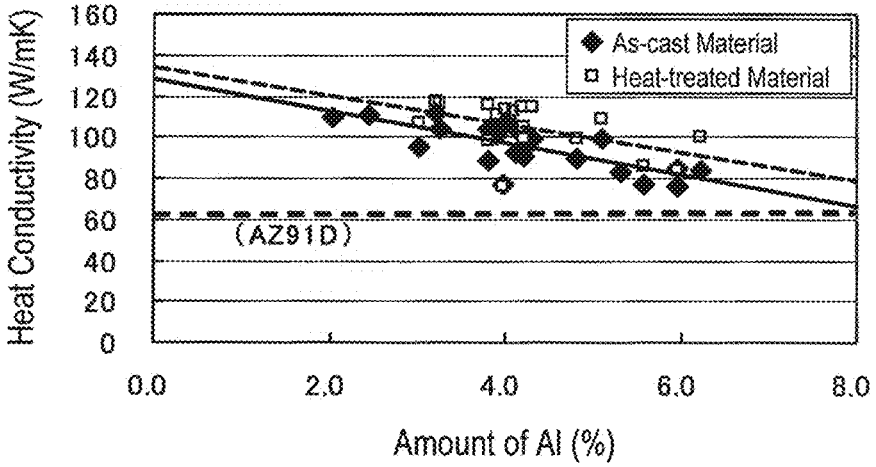
FIG. 6 is a graph that illustrates correlations between the heat conductivities of Mg-alloy cast products and the Al Amounts.

Correlations between the Al amounts in the analyzed compositions of the respective test specimens and the high-temperature characteristic of the respective test specimens (e.g., the heat conductivity) are illustrated in FIG. 6 based on Table 1. It is preferable that Al can be present in an amount of 2% or more, because it is effective in upgrading the ordinary-temperature strength of the Mg-alloy cast product. However, as can be apparent from FIG. 6, the increase in the Al amount tended to lower the heat conductivity so that, when Al exceeded 8%, the heat conductivity became approximately equal to that of the conventional common Mg alloy (e.g., AZ91D). This tendency was the same not only in the as-cast materials but also in the heat-treated materials. Note however that the heat-treated materials became larger in the heat conductivity by from 5 to 10 W/mk as a whole than did the as-cast materials.

From those above mentioned, it is possible to say that, in order to make the ordinary-temperature characteristics of the test specimens compatible with the high-temperature characteristics in higher dimension, it is more preferable to set Al so as to fall in a range of from 2 to 6%, or further in a range of from 3 to 5%.

(3) Influences of Ca

Figure 7:
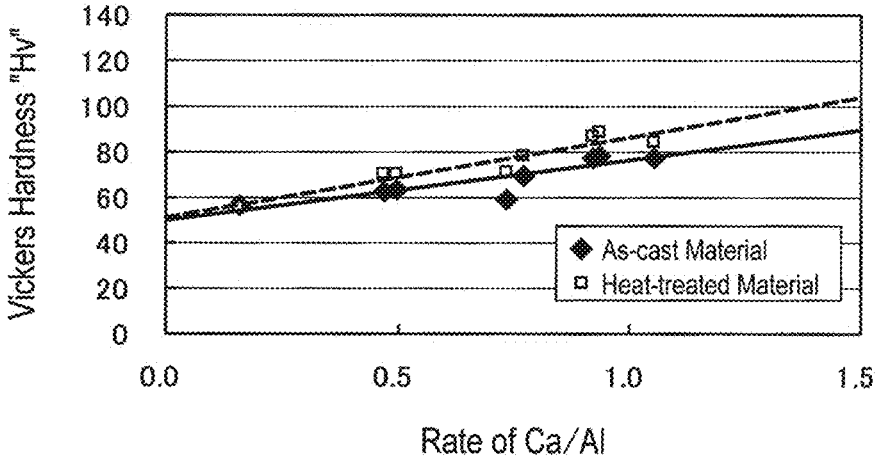
FIG. 7 is a graph that illustrates correlations between the hardnesses of Mg-alloy cast products and the Ca/Al ratios.
Figure 8:
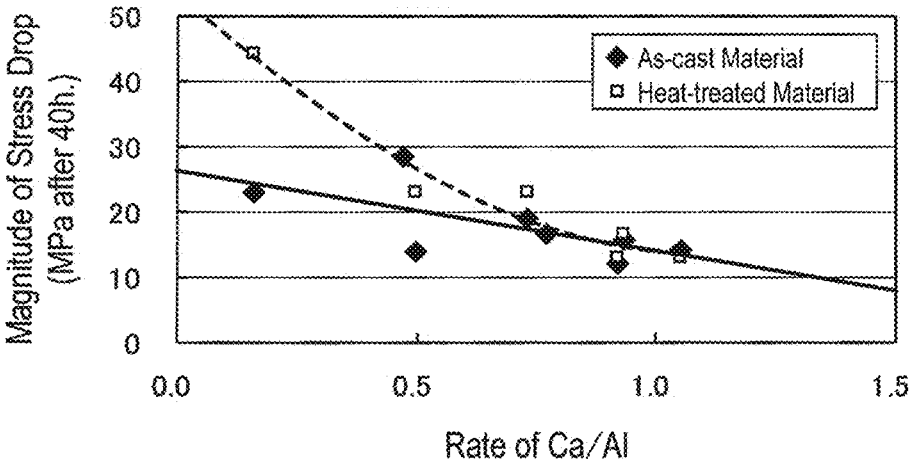
FIG. 8 is a graph that illustrates correlations between the stress-drop magnitudes of Mg-alloy cast products and Ca/Al ratios.
Figure 9:
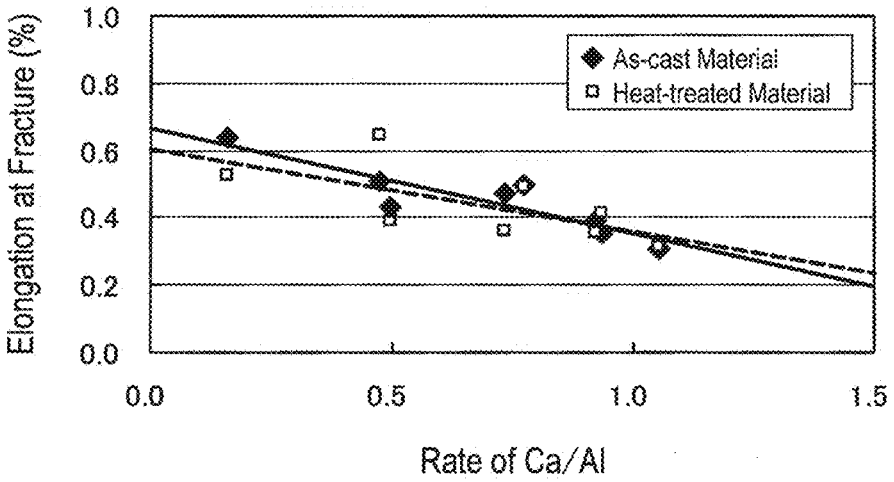
FIG. 9 is a graph that illustrates correlations between the elongations of Mg-alloy cast products and the Ca/Al ratios.

Correlations between the Ca amounts (e.g., especially, the Ca/Al ratios) in the analyzed compositions of the respective test specimens and the characteristics of the respective test specimens are illustrated in FIG. 7 through FIG. 9 based on Table 1. Note that, on the graphs shown in these diagrams, data, in which the "Sr/Al" fell in a range of from 0.3 to 0.7, were plotted in order to make influences of Ca (or Ca/Al) clear.

(i) First of all, as can be apparent from FIG. 7, the more the "Ca/Al" increased the more the hardness upgraded. This seems to occur because of increasing hard Al—Ca-system compounds. Although this tendency was the same not only in the as-cast materials but also in the heat-treated materials, such a tendency was greater in the heat-treated materials than in the as-cast materials.

(ii) Besides, as can be apparent from FIG. 8, the more the "Ca/Al" increased the more the magnitude of stress drop declined (that is, the more the creep resistance upgraded). This seems to occur because of the following: Mg—Al-system compounds with low melting points diminished, and so Al—Ca-system compounds with high melting points increased. And, because the magnitudes of stress drop in the as-cast materials became larger considerably when the "Ca/Al" was less than 0.5, it is understood that the "Ca/Al" can preferably be 0.5 or more. Although this tendency was the same not only in the as-cast materials but also in the heat-treated materials, it was more prominent in the heat-treated materials than in the as-cast materials.

(iii) On the other hand, as can be apparent from FIG. 9, the more "Ca/Al" increased, the more the elongation at fracture decreased. This tendency was the same not only in the as-cast materials but also in the heat-treated materials, and so there was not any remarkable difference between both of them. Because a magnesium-alloy product whose elongation at fracture is smaller than 0.2% is not preferable as structural materials, it is possible to say that the "Ca/Al" can preferably be 1.5 or less.

From those above mentioned, it is more preferable to set the "Ca/Al" so as to fall in a range of from 0.5 to 1.5, or further in a range of from 0.5 to 1provided that the ordinary-temperature characteristics (e.g., the hardness and elongation) of the test specimens are made compatible with the high-temperature characteristic (e.g., the heat conductivity) in higher dimension.

(iv) For reference, when Al is from 2 to 6% and the "Ca/Al" is from 0.5 to 1.5, Ca makes from 1 to 9%. However, according to studies by the present inventors, it is preferable that Ca can also be from 2 to 6% because favorable results are obtainable when the "Ca/Al" is at around about 1.

(4) Influences of Mn

Figure 10:
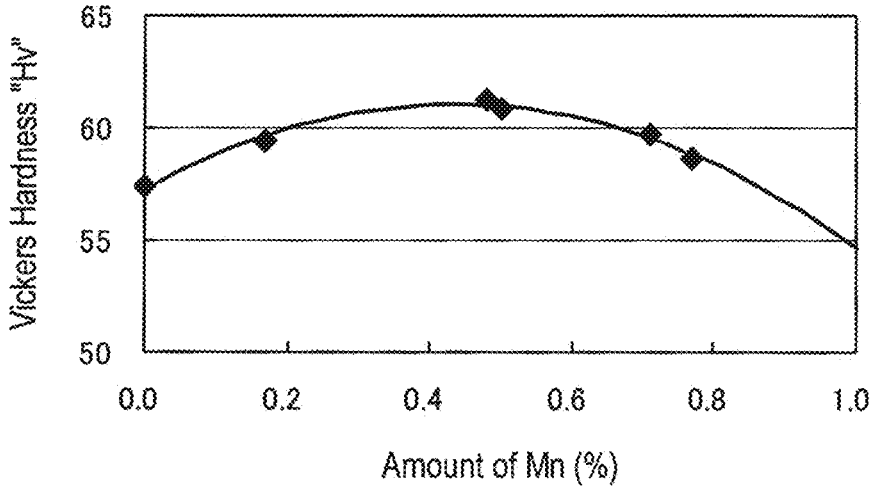
FIG. 10 is a graph that illustrates a correlation between the hardnesses of Mg-alloy cast products and the Mn amounts.
Figure 11:
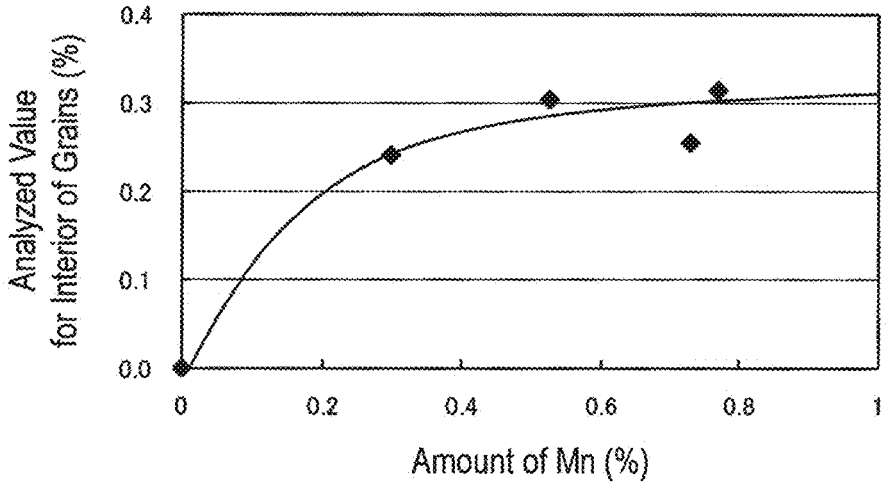
FIG. 11 is a graph that illustrates a correlation between the Mn amounts in the entirety of Mg-alloy cast products and the analyzed Mn values within their crystalline grains.

Correlations between the Mn amounts in the analyzed compositions of the respective test specimens and the characteristics of the respective test specimens are illustrated in FIG. 10 and FIG. 11 based on Table 1. Note that, on the graphs shown in these diagrams, data, which Mg-3% Al-3% Ca-0% Sr-x % Mn exhibited, were plotted in order to make influences of Mn clear. Moreover, how metallic structures of the test specimens changed depending on the Mn amounts is shown in FIG. 12.

First of all, as can be apparent from FIG. 10, it is seen that the hardness made a relative maximum when Mn was in the vicinity of from 0.3 to 0.5%, and that a sufficient hardness is hence obtainable when Mn is in the vicinity of from 0.1 to 0.7% that involves previous and subsequent ranges to the former range.

FIG. 11 is a result of analyzing Mn amounts within crystalline grains (or α phases) by means of EPMA. As can be apparent from this FIG. 11, although the analyzed values within the crystalline grains had a proportional relation with the entire Mn amount in the test specimens when the latter was up to about 0.2%, the analyzed values (or solving amounts) became to be saturated. Therefore, it is understood that the solubility limit of Mn into the α phases (or crystalline grains) is 0.3% approximately.

Figure 12:
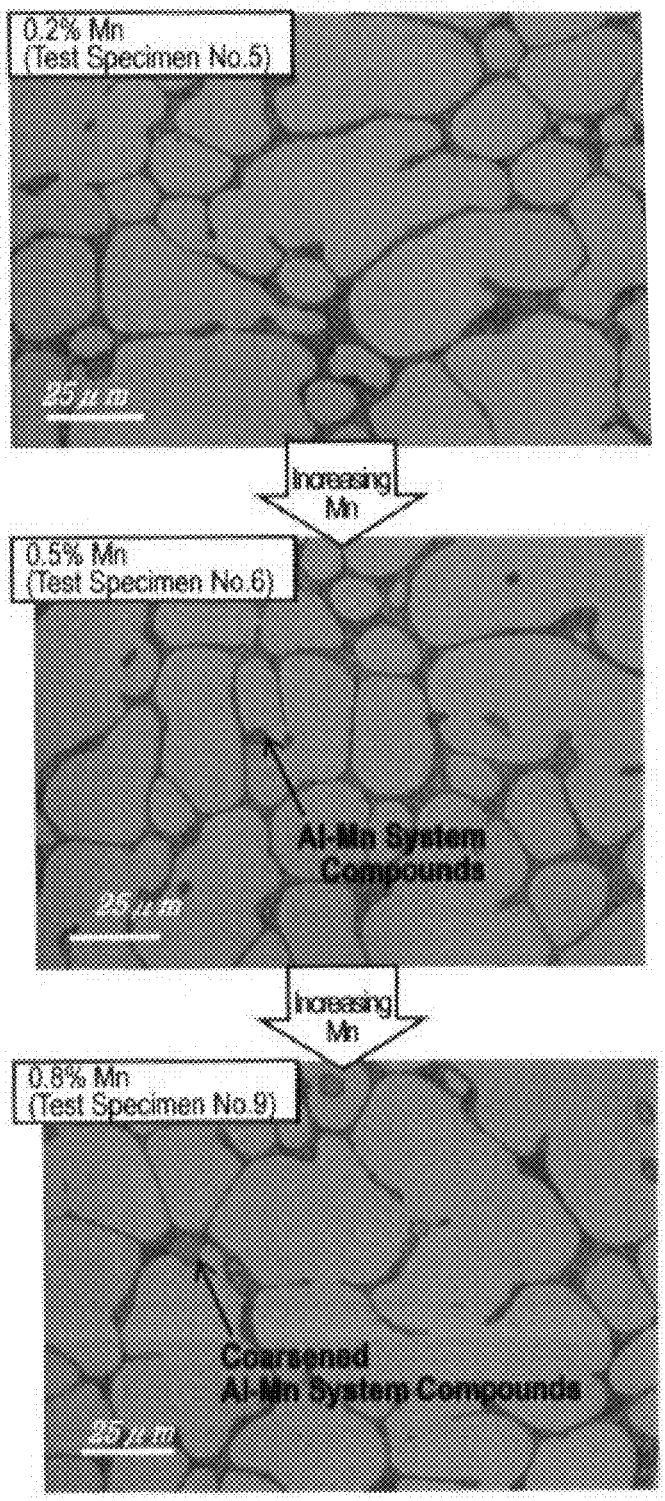
FIG. 12 is metallographic photographs that show the metallic structures of Mg-alloy cast products with different Mn amounts.

It is understood herein that the excessive Mn that surpassed the solid solubility limit within the grains crystallized or precipitated as Al—Mn-system compounds in the grain boundaries and then the resulting compounds coarsened along with the increase of the Mn amount, as can be seen from FIG. 12. This coarsening of the Al—Mn-system compounds is believed to one of the causes that lower the characteristics of the Mg-alloy cast product, such as the hardness.

(5) It was understood from the above that the Mg alloy (or cast product), which comprises: Al in an amount of from 2 to 6%; Ca in an amount making the "Ca/Al" being from 0.5 to 1.5; Mn in an amount of from 0.1 to 0.7% and Sr in an amount of from 1 to 6%, is good in terms of various characteristics.

TABLE 1A

| | Blended Composition (% by mass) | | | | | | | Analyzed Composition (% by mass) | | | | | | |
|---|---|---|---|---|---|---|---|---|---|---|---|---|---|---|
| No. | Al | Ca | Sr | Mn | Ca/Al | Sr/Al | Sr/Ca | Al | Ca | Sr | Mn | Ca/Al | Sr/Al | Sr/Ca |
| 1 | 2.0 | 3.0 | 0.0 | 0.5 | 1.5 | 0.0 | 0.0 | 2.0 | 2.8 | 0.0 | 0.5 | 1.4 | 0.0 | 0.0 |
| 2 | 2.0 | 3.0 | 0.2 | 0.5 | 1.5 | 0.1 | 0.1 | 2.4 | 2.9 | 0.1 | 0.3 | 1.2 | 0.0 | 0.0 |
| 3 | 3.0 | 1.5 | 3.0 | 0.0 | 0.5 | 1.0 | 2.0 | 3.0 | 1.4 | 2.2 | 0.0 | 0.5 | 0.7 | 1.5 |
| 4 | 3.0 | 3.0 | 0.0 | 0.0 | 1.0 | 0.0 | 0.0 | 3.5 | 3.5 | 0.0 | 0.0 | 1.0 | 0.0 | 0.0 |
| 5 | 3.0 | 3.0 | 0.0 | 0.3 | 1.0 | 0.0 | 0.0 | 3.4 | 3.5 | 0.0 | 0.2 | 1.0 | 0.0 | 0.0 |
| 6 | 3.0 | 3.0 | 0.0 | 0.5 | 1.0 | 0.0 | 0.0 | 3.2 | 3.0 | 0.0 | 0.5 | 0.9 | 0.0 | 0.0 |
| 7 | 3.0 | 3.0 | 0.0 | 1.0 | 1.0 | 0.0 | 0.0 | 3.2 | 3.4 | 0.0 | 0.5 | 1.1 | 0.0 | 0.0 |
| 8 | 3.0 | 3.0 | 0.0 | 2.0 | 1.0 | 0.0 | 0.0 | 3.2 | 3.2 | 0.0 | 0.7 | 1.0 | 0.0 | 0.0 |
| 9 | 3.0 | 3.0 | 0.0 | 3.0 | 1.0 | 0.0 | 0.0 | 3.0 | 3.2 | 0.0 | 0.8 | 1.1 | 0.0 | 0.0 |
| 10 | 3.0 | 3.0 | 1.0 | 0.5 | 1.0 | 0.3 | 0.3 | 3.3 | 2.7 | 0.6 | 0.2 | 0.8 | 0.2 | 0.2 |
| 11 | 3.0 | 3.0 | 2.0 | 0.3 | 1.0 | 0.7 | 0.7 | 3.8 | 2.8 | 1.2 | 0.2 | 0.7 | 0.3 | 0.4 |
| 12 | 4.0 | 2.0 | 3.0 | 0.5 | 0.5 | 0.8 | 1.5 | 4.1 | 2.0 | 2.0 | 0.3 | 0.5 | 0.5 | 1.0 |
| 13 | 4.0 | 3.6 | 0.5 | 0.3 | 0.9 | 0.1 | 0.1 | 4.3 | 3.5 | 0.4 | 0.1 | 0.8 | 0.1 | 0.1 |
| 14 | 4.0 | 3.7 | 1.0 | 0.3 | 0.9 | 0.3 | 0.3 | 4.2 | 3.6 | 0.8 | 0.2 | 0.9 | 0.2 | 0.2 |
| 15 | 4.0 | 3.5 | 2.0 | 0.3 | 0.9 | 0.5 | 0.6 | 4.2 | 3.2 | 2.0 | 0.2 | 0.8 | 0.5 | 0.6 |
| 16 | 4.0 | 3.0 | 6.0 | 0.3 | 0.8 | 1.5 | 2.0 | 4.0 | 2.6 | 5.2 | 0.1 | 0.7 | 1.3 | 2.0 |
| 17 | 4.0 | 4.0 | 0.0 | 0.5 | 1.0 | 0.0 | 0.0 | 4.0 | 3.6 | 0.0 | 0.3 | 0.9 | 0.0 | 0.0 |
| 18 | 4.0 | 4.0 | 0.4 | 0.0 | 1.0 | 0.1 | 0.1 | 4.1 | 3.9 | 0.2 | 0.0 | 1.0 | 0.0 | 0.0 |
| 19 | 4.0 | 4.0 | 1.0 | 0.0 | 1.0 | 0.3 | 0.3 | 3.9 | 3.9 | 0.6 | 0.0 | 1.0 | 0.2 | 0.2 |
| 20 | 4.0 | 4.0 | 3.0 | 0.0 | 1.0 | 0.8 | 0.8 | 3.8 | 4.0 | 2.2 | 0.0 | 1.1 | 0.6 | 0.6 |
| 21 | 4.0 | 6.0 | 1.0 | 0.3 | 1.5 | 0.3 | 0.2 | 4.2 | 5.8 | 1.0 | 0.1 | 1.4 | 0.2 | 0.2 |
| 22 | 5.0 | 2.5 | 1.0 | 0.5 | 0.5 | 0.2 | 0.4 | 4.8 | 2.2 | 0.6 | 0.3 | 0.5 | 0.1 | 0.3 |
| 23 | 5.0 | 4.6 | 1.0 | 0.3 | 0.9 | 0.2 | 0.2 | 5.1 | 4.5 | 0.7 | 0.1 | 0.9 | 0.1 | 0.1 |
| 24 | 5.0 | 5.0 | 3.0 | 0.0 | 1.0 | 0.6 | 0.6 | 5.3 | 5.0 | 2.4 | 0.0 | 0.9 | 0.4 | 0.5 |
| 25 | 6.0 | 1.0 | 3.0 | 0.5 | 0.2 | 0.5 | 3.0 | 5.6 | 0.9 | 2.2 | 0.3 | 0.2 | 0.4 | 2.4 |
| 26 | 6.0 | 3.0 | 1.0 | 0.0 | 0.5 | 0.2 | 0.3 | 6.0 | 2.8 | 0.7 | 0.0 | 0.5 | 0.1 | 0.3 |
| 27 | 6.0 | 6.0 | 3.0 | 0.5 | 1.0 | 0.5 | 0.5 | 6.2 | 5.7 | 1.7 | 0.2 | 0.9 | 0.3 | 0.3 |
| 28 | 6.0 | 6.0 | 6.0 | 0.3 | 1.0 | 1.0 | 1.0 | 6.0 | 5.7 | 5.0 | 0.1 | 1.0 | 0.8 | 0.9 |
| C1 | AZ91D (e.g., Commercially Available Mg Alloy) | | | | | | | | | | | | | |

TABLE 1B

| | High-Temperature Characteristics | | | | Room-Temperature Characteristics | | | | | | |
|---|---|---|---|---|---|---|---|---|---|---|---|
| | Heat Conductivity (W/(m · K)) | | Creep Resistance (at 200° C. for 40 hr.) Magnitude of Stress Drop (MPa) | | Hardness (Hv) | | Tensile Strength (MPa) | | Elongation (%) | | Castability |
| No. | As-cast Material | Heat-treated Material | As-cast Material | Heat-treated Material | As-cast Material | Heat-treated Material | As-cast Material | Heat-treated Material | As-cast Material | Heat-treated Material | Molten-metal Flowability (mm) |
| 1 | 110 | | 21.3 | | 58 | | 117 | | 1.1 | | 420 |
| 2 | 111 | | 19.6 | | 61 | | 114 | | 1.0 | | 432 |
| 3 | 96 | 107 | 28.4 | | 62 | 71 | 92 | 120 | 0.5 | 0.6 | 467 |
| 4 | | | | | 57 | | 122 | | 1.7 | | |
| 5 | | | 24.4 | | 59 | | 124 | | 1.6 | | |
| 6 | 112 | 117 | 26.9 | 24.4 | 61 | 70 | 119 | 153 | 1.2 | 0.8 | 393 |
| 7 | | | 17.9 | | 61 | | 123 | | 1.2 | | |
| 8 | | | 22.3 | | 60 | | 124 | | 1.5 | | |
| 9 | | | 15.0 | | 59 | | 107 | | 0.8 | | |
| 10 | 104 | 117 | 19.3 | 20.8 | 59 | 71 | 81 | 123 | 0.5 | 0.5 | 463 |
| 11 | 105 | 115 | 19.1 | 22.9 | 59 | 72 | 72 | 102 | 0.5 | 0.4 | 523 |
| 12 | 92 | | 13.9 | 23.0 | 63 | 70 | 93 | 105 | 0.4 | 0.4 | 554 |
| 13 | 99 | 115 | 22.8 | 26.4 | 60 | 73 | 90 | 129 | 0.6 | 0.5 | |
| 14 | 101 | 114 | 17.4 | 17.2 | 61 | 74 | 98 | 147 | 0.6 | 0.6 | 538 |
| 15 | 94 | 105 | 16.6 | 16.4 | 70 | 79 | 90 | 129 | 0.5 | 0.5 | |
| 16 | 77 | 76 | 9.3 | 9.0 | 78 | 89 | 73 | 87 | 0.3 | 0.2 | |
| 17 | 107 | 114 | 24.8 | 23.4 | 57 | 75 | 95 | 108 | 0.4 | 0.3 | 535 |
| 18 | 105 | 112 | 26.5 | 26.5 | 63 | 73 | 95 | 117 | 0.6 | 0.4 | 506 |
| 19 | 101 | 110 | 24.5 | 26.8 | 67 | 74 | 81 | 125 | 0.5 | 0.5 | 577 |
| 20 | 89 | 99 | 14.2 | 13.0 | 78 | 84 | 86 | 105 | 0.3 | 0.3 | 627 |
| 21 | 91 | 99 | 9.4 | 9.3 | 76 | 83 | 94 | 140 | 0.4 | 0.6 | |
| 22 | 89 | 99 | 18.5 | 37.9 | 59 | 60 | 94 | 148 | 0.8 | 2.6 | 543 |
| 23 | 100 | 109 | 18.7 | 24.1 | 68 | 76 | 74 | 105 | 0.4 | 0.4 | 557 |
| 24 | 82 | | 15.6 | 16.7 | 79 | 88 | 84 | 121 | 0.4 | 0.4 | 523 |
| 25 | 77 | 86 | 23.2 | 44.2 | 56 | 55 | 98 | 86 | 0.6 | 0.5 | 500 |
| 26 | 84 | | 26.1 | | 62 | 61 | 84 | | 0.6 | | 483 |
| 27 | 84 | 100 | 12.1 | 13.1 | 78 | 87 | 102 | 115 | 0.4 | 0.4 | 578 |
| 28 | 76 | 84 | 5.2 | 5.0 | 100 | 108 | 87 | 120 | 0.2 | 0.3 | |
| C1 | 58 | | 60.1 | | 63 | | 189 | | 4.7 | | 420 |

The invention claimed is:

1. A magnesium alloy being characterized in that it comprises:

aluminum (Al) in an amount of from 2 to 5.5% by mass (hereinafter being simply referred to as "%");

calcium (Ca) in an amount to satisfy a compositional ratio of Ca to Al of from 0.7 to 1.0;

manganese (Mn) in an amount of from 0.1 to 0.7%;

strontium (Sr) in an amount of from 1.5 to 6%; and the balance being magnesium (Mg), and inevitable impurities and/or a modifying element;

when the entirety is taken as 100%.

2. The magnesium alloy as set forth in claim 1, wherein said Sr is from 1.5 to 2.5%.

3. A magnesium-alloy cast product being characterized in that it comprises the magnesium alloy as set forth in claim 1.

4. The magnesium-alloy cast product as set forth in claim 3 onto which the following have been performed:

a solution treatment in which it is cooled rapidly after being heated to a temperature that is higher than or equal to that of a solubility curve; and an aging heat treatment in which it is held at another temperature that is less than that of the solubility curve after the solution treatment.

5. The magnesium alloy as set forth in claim 1, wherein said Al is from 3 to 5%.

6. A magnesium alloy being characterized in that it comprises:

aluminum (Al) in an amount of from 2 to 6% by mass (hereinafter being simply referred to as "%");

calcium (Ca) in an amount making a compositional ratio of Ca to Al of from 0.7 to 1.0;

manganese (Mn) in an amount of from 0.1 to 0.7%;

strontium (Sr) in an amount of from 2 to 6%; and the balance being magnesium (Mg), and inevitable impurities and/or a modifying element;

when the entirety is taken as 100%.

7. A magnesium-alloy cast product being characterized in that it comprises the magnesium alloy as set forth in claim 6.

8. The magnesium-alloy cast product as set forth in claim 7 onto which the following have been performed:

a solution treatment in which it is cooled rapidly after being heated to a temperature that is higher than or equal to that of a solubility curve; and an aging heat treatment in which it is held at another temperature that is less than that of the solubility curve after the solution treatment.

* * * * *